US007347763B2

(12) United States Patent
Ewringmann

(10) Patent No.: US 7,347,763 B2
(45) Date of Patent: Mar. 25, 2008

(54) TOY VEHICLE FOR CHILDREN

(75) Inventor: Ulrich Ewringmann, Taufkirchen (DE)

(73) Assignee: Franz Schneider GmbH & Co. KG, Coburg (DE)

( * ) Notice: Subject to any disclaimer, the term of this patent is extended or adjusted under 35 U.S.C. 154(b) by 508 days.

(21) Appl. No.: 10/990,781

(22) Filed: Nov. 17, 2004

(65) Prior Publication Data

US 2006/0105669 A1 May 18, 2006

(30) Foreign Application Priority Data

Sep. 3, 2004 (DE) ..... 10 2004 042 646

(51) Int. Cl.
*A63H 17/12* (2006.01)
*A63H 17/14* (2006.01)

(52) U.S. Cl. ..... 446/427; 446/426; 414/915

(58) Field of Classification Search ..... 446/425–427; 212/232, 180, 241; 414/618, 624, 915; 280/200, 280/755, 762, 763.1, 151
See application file for complete search history.

(56) References Cited

U.S. PATENT DOCUMENTS

| | | | | | |
|---|---|---|---|---|---|
| 830,783 | A | * | 9/1906 | Groesbeck | 414/687 |
| 1,423,724 | A | * | 7/1922 | Mascetti | 212/180 |
| 1,955,457 | A | * | 4/1934 | Gaver | 446/426 |
| 2,192,807 | A | * | 3/1940 | Strom | 446/426 |
| 2,478,084 | A | * | 8/1949 | Brown | 414/694 |
| 2,523,093 | A | * | 9/1950 | Byrne | 414/694 |
| 2,630,925 | A | * | 3/1953 | Boone | 212/231 |
| 2,822,641 | A | * | 2/1958 | McDonald | 446/426 |
| 2,985,983 | A | * | 5/1961 | Konstenius | 446/426 |
| 3,176,862 | A | * | 4/1965 | Walters et al. | 414/690 |
| 3,205,612 | A | * | 9/1965 | Zbikowski | 446/426 |
| 3,358,850 | A | * | 12/1967 | Neils | 212/174 |
| 3,393,469 | A | * | 7/1968 | Balthazor | 446/426 |
| 3,593,866 | A | * | 7/1971 | Gazdarica | 414/569 |
| 3,624,957 | A | * | 12/1971 | Good | 446/425 |
| 3,811,582 | A | * | 5/1974 | Shumaker et al. | 414/694 |
| 3,926,316 | A | * | 12/1975 | Luttrell | 212/259 |
| 4,150,839 | A | * | 4/1979 | Tucker et al. | 280/771 |
| 4,278,394 | A | * | 7/1981 | Johnson | 414/694 |
| D267,100 | S | * | 11/1982 | Magnusson | D21/431 |
| 4,552,274 | A | * | 11/1985 | Lundin | 212/232 |
| 4,712,968 | A | * | 12/1987 | Manning | 414/694 |
| 5,299,905 | A | * | 4/1994 | Rademacher | 414/624 |
| D359,769 | S | * | 6/1995 | Goncalves | D21/537 |
| D431,575 | S | * | 10/2000 | Park | D15/25 |
| 2002/0105182 | A1 | * | 8/2002 | Huntsberger et al. | 280/827 |

* cited by examiner

*Primary Examiner*—Eugene Kim
*Assistant Examiner*—Alyssa M Hylinski
(74) *Attorney, Agent, or Firm*—Greer, Burns & Crain, Ltd.

(57) ABSTRACT

The toy vehicle is characterized in that a rear excavator is fastened to the toy vehicle, that a seat boom is rotatably arranged on a receiving block which is fastened to the toy vehicle, that a support leg is mounted on the receiving block and is pivotable between a raised position and a lowered position in which the support leg rests on the ground, and that the receiving block has mounted thereon a securing hook means which in a first position locks the support leg in the raised position and, at the same time, locks the seat boom in a predetermined angular position and which in a second position secures the support leg in the lowered position and, moreover, releases the seat boom for rotation. The toy vehicle can also be operated by small children and meets high safety standards.

8 Claims, 5 Drawing Sheets

TOY VEHICLE FOR CHILDREN

FIELD OF THE INVENTION

The present invention relates to a toy vehicle, especially a pedal vehicle for children, which is preferably in the form of a tractor without the invention being limited thereto. In principle, the invention is also applicable to a motor-driven toy vehicle.

SUMMARY OF THE INVENTION

It is the object of the present invention to develop a vehicle of the contemplated type in such a way that the play value of the vehicle is enhanced. The vehicle should also be operable by young children and meet high safety standards.

This object is achieved according to the invention by a toy vehicle, especially a pedal vehicle for children, comprising a rear excavator fastened to the toy vehicle, a seat boom rotatably arranged on a receiving block which is fastened to the toy vehicle, a support leg mounted on the receiving block and pivotable between a lifted position and a lowered position in which the support leg rests on the ground, and the receiving block has mounted thereon a securing hook means which in a first position locks the support leg in the raised position and, at the same time, locks the seat boom in a predetermined angular position and which in a second position secures the support leg in the lowered position and, moreover, releases the seat boom for rotation.

Further advantageous developments of the invention are described below.

According to the invention the toy vehicle has fastened thereto a rear excavator which is fastened by means of a receiving block to the rear side of the vehicle body. The receiving block preferably includes a coupling bolt which passes through annular coupling elements of the vehicle body.

The receiving block has rotatably fastened thereto a seat boom which consists of a boom and a seat shell fastened thereto. The boom has fastened thereto a linkage preferably made of plastics, which holds an excavator shovel and which is preferably provided with two handles for lifting, lowering and pivoting the excavator shovel.

Furthermore, according to the invention the receiving block has mounted thereon a support leg which is pivotable between a raised and preferably laterally swung-out position and a lowered position in which the support leg rests with a foot on the ground. Moreover, according to the invention the receiving block has mounted thereon a securing hook means which in a first position locks the support leg in the raised position and, at the same time, locks the seat boom in a predetermined angular position and which in a second position blocks the support leg in the lowered position, the seat boom being additionally released for rotation.

When a child is traveling with the toy vehicle, the support leg must of course be in the raised position because, otherwise, the support leg would drag along the ground. For fixing the support leg in the raised position the securing hook of the securing hook means is brought into a position in which the hook grips over the support leg so that said leg is immovably held. The seat boom is here locked in a predetermined angular position, whereby a situation is prevented where the seat boom with the mounted linkage and the excavator shovel can pivot back and forth during travel of the toy vehicle.

When the child wishes to use the rear excavator, he/she will first move the securing hook into a preferably slightly raised position in which the support leg is released from the securing hook and is movable into the lowered position in which the support leg rests on the ground. If this is the case, the securing hook is moved into a second, preferably downwardly pivoted position in which the support leg is blocked and the seat boom is simultaneously released for rotation. Preferably, the securing hook is here rotatably arranged, i.e., it is rotated into the various positions.

Since the receiving block with the rear excavator is supported by the support leg on the ground, the child can now sit down without any risk on the preferably provided seat shell of the seat boom without the toy vehicle being able to tilt about the rear axle and without the forces that are acting on the receiving block being in a position to damage the toy vehicle. Since the seat boom is released for rotation, the rear excavator can now be pivoted within the intended range of rotation.

Since the two above-described states are created and secured by rotating a single securing hook means, easy operability is ensured. The arrangement of toy vehicle and rear excavator satisfies high safety standards.

With great advantage the securing hook means comprises a securing hook which is rotatable about an axis, an engaging means which is non-rotatably connected to the securing hook, and a securing bolt which is arranged in the receiving block.

The securing bolt is displaceably arranged in the receiving block, namely between an upper position in which it engages with its upper end into a recess in the bottom side of the seat boom, and a lower position in which it engages with its lower end into a recess of the lowered support leg. The engaging means which is firmly connected to the rotational axis comprises a rod-like engaging section which extends in a direction transverse to the axis and which engages into a space between two lateral stops of the securing bolt, so that the securing bolt is displaceable upwards or downwards by rotating the securing hook and the engaging means connected thereto.

When the support leg is in the raised position, its position can be secured in that the securing hook grips behind the support leg with its hook-like projection at the side facing away from the axis thereof. To be able to pivot the support leg into the lowered support position, the securing hook is slightly pivoted upwards without its engaging means hitting against the securing bolt as the engaging means has a corresponding play between the two stops of the securing bolt. The securing hook is only rotated upwards to such a degree that the support leg can be pivoted outwards. The support leg preferably contains two support leg sections extending at an angle relative to one another and is pivotable with its end facing away from the support foot about an axis inclined relative to the vertical. The angle is preferably about 45°.

When the support leg is pivoted such that its lower support leg section has assumed a vertical position and rests with the support leg on the ground, the securing hook is pivoted downwards to a stop, the securing bolt being shifted in this process and entering with its lower end into a lateral recess of the support foot, whereby the position thereof is secured. The upper end of the securing bolt has exited from the recess of the seat boom so that said boom is freely rotatable.

As has been mentioned above, the seat boom has fastened thereto a linkage holding a shovel, with which the shovel can be moved into the desired and angular position. The linkage includes an excavator arm which is hinged with one end to the seat boom and which at the other end hingedly supports a shovel arm with a shovel hinged thereto, the excavator arm being adapted to be pivoted back into a raised end position in which the excavator arm is detachably fixable. To this end it is suggested that the excavator arm should have pivotably mounted thereon a second securing hook which due to gravity in the pivoted-back end position of the excavator arm grips behind a stop mounted on the seat boom. The second securing hook is here rotatable about a horizontal axis. The excavator arm is released by pivoting the second securing hook upwards.

BRIEF DESCRIPTION OF THE DRAWINGS

Further details of the invention will become apparent from the following description of a preferred embodiment of the toy vehicle and from the drawings, in which.

DETAILED DESCRIPTION OF PREFERRED EMBODIMENT

Figure 1:
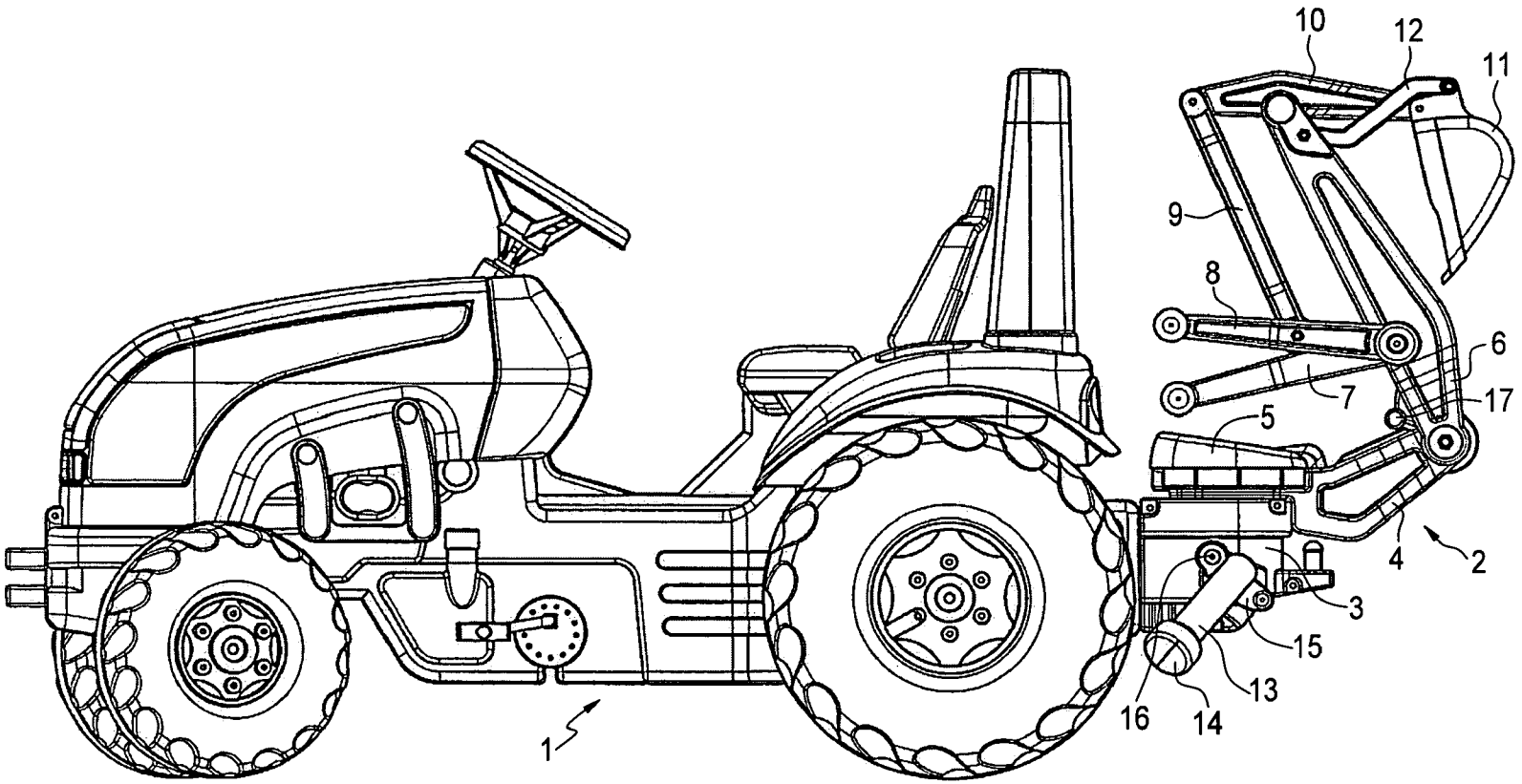
FIG. 1 is a side view of a pedal-operated toy tractor for children with a rear excavator fastened thereto and having a lifted support leg and a locked excavator arm.

As shown in FIG. 1, the rear of a pedal-operated toy tractor 1 for children has firmly mounted thereon a rear excavator, which is marked by reference numeral 2 on the whole. To this end a receiving block 3 is fixed by means of a coupling bolt 4 (FIG. 5) to the vehicle body 1, the bolt 4 passing through coupling rings on the vehicle body 1.

A seat boom 4 is rotatably fastened to the receiving block 3 and is provided with a seat shell 5 below which the swivel joint is positioned.

The free end of the boom 4 has hinged thereto an excavator arm 6 on which a rigidly fastened handle 7 and a hingedly supported handle 8 are mounted laterally side by side. The pivotable handle 8 is hingedly connected in its central portion to a parallel rod 9 whose free end has hinged thereto a shovel arm 10 which at such a position is also hinged to the free end of the excavator arm 6 so that the parallel rod 9 extends in parallel with the excavator arm 6.

The shovel arm 10 is hingedly connected at its free end to an excavator shovel 11 which is also hingedly connected to the excavator arm 6 via a shear-type linkage 12.

Moreover, the receiving block 3 has hingedly supported thereon a support leg 13 with a lower support foot 14. In the illustration of FIG. 1, the support leg 13 is in a lifted state which is laterally pivoted out of the receiving block 3 and which is secured by a first securing hook 15 that is rotatable about an axis 16. In the illustrated state, the securing hook 15 grips with its hook-like projection over the rear side of the upper bent section of the support leg 13, the rear side being here oriented away from the axis 16.

Furthermore, FIG. 1 shows a second securing hook 17 which in the illustrated lifted end position of the rear excavator grips behind a projection 18 formed on the seat boom 4 in such a way that the excavator arm 6 in the illustrated position is detachably fixed.

Figure 2:
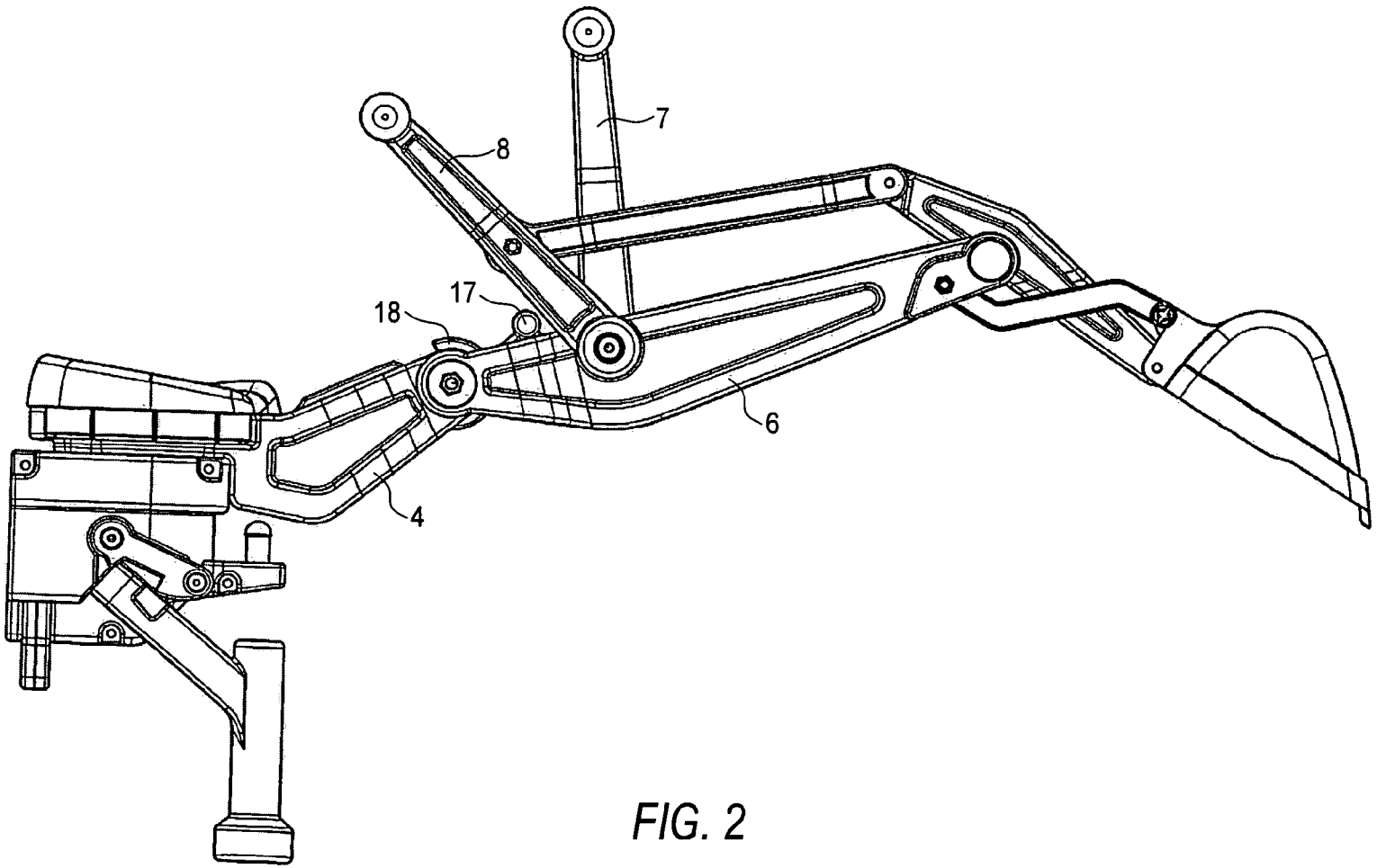
FIG. 2 is a side view of the rear excavator with lifted support leg and released excavator arm.

FIG. 2 shows a state of the rear excavator in which the excavator arm 6 is released. The second securing hook 17 was previously disengaged, by way of lifting, from the projection 18 formed on the front end of the seat boom 4 so that the excavator arm was pivotable in forward direction.

Figure 3A:
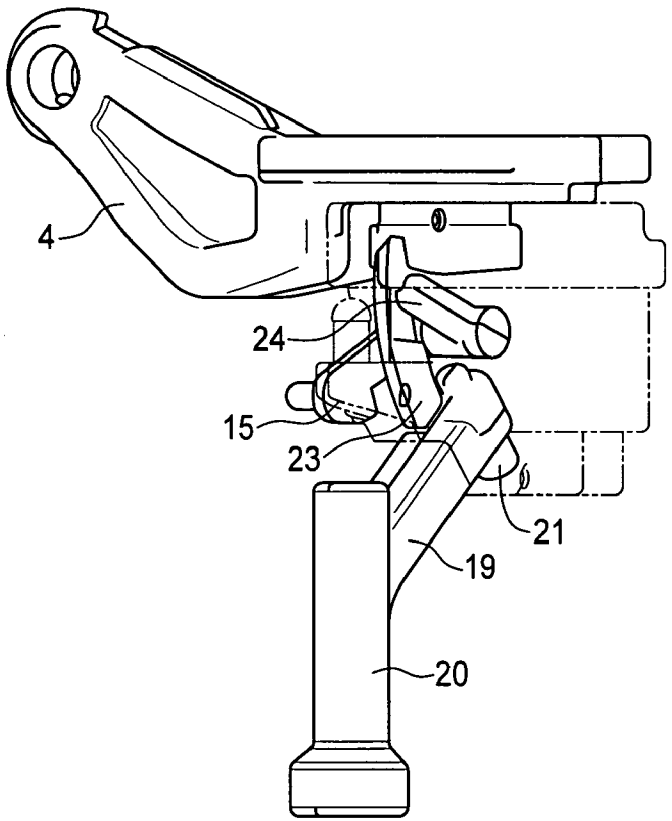
FIGS. 3A and 3B show the rear excavator with lowered and locked support leg.
Figure 3B:
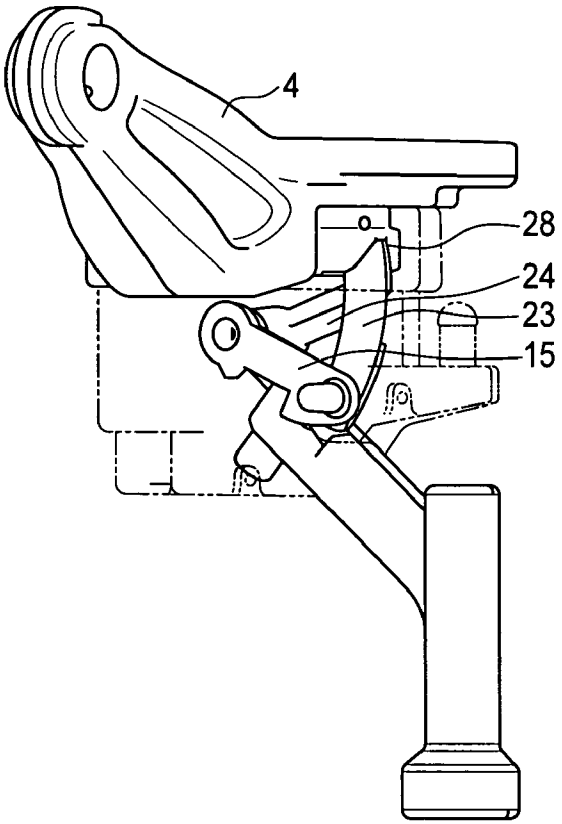
Figure 4A:
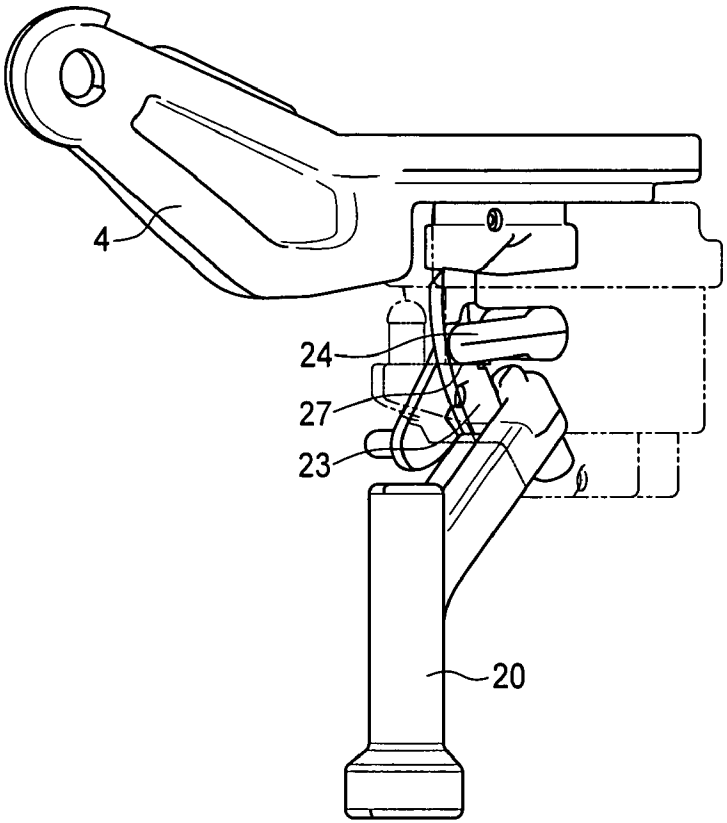
FIGS. 4A and 4B show the arrangement of FIGS. 3A and 3B with released support leg.
Figure 4B:
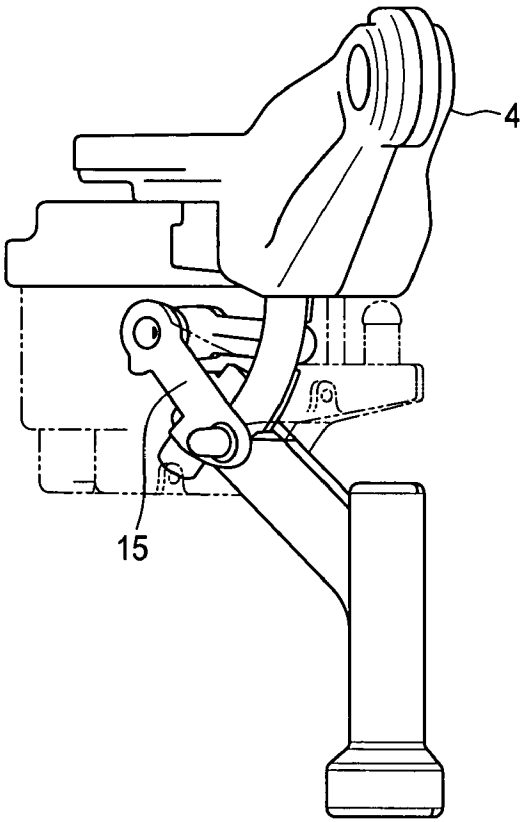

FIGS. 3 and 4 show that the support leg 13 consists of an upper support leg section 19 and a lower support leg section 20, and that the upper support leg section 19 is pivotable about an axis 21 inclined relative to the vertical. The securing hook 15 is connected to a securing bolt 23 via an engaging means 22 (FIG. 5) which is non-rotatably connected to the securing hook and which has a rod-like engaging attachment positioned in a direction perpendicular to the plane of FIG. 5, the connection being established in that the engaging attachment 24 engages into an elongated recess 25 of the securing bolt 23 between two stops 26 and 27 whose distance is greater than the width of the engaging attachment 24.

FIG. 3 shows the state in which the support leg 13 is pivoted into the vertical support position. The securing bolt 23 is still in the upwardly shifted position in which it engages with its upper end into a recess 28 of a swivel pin formed on the bottom side of the seat boom 4, so that the seat boom 4 is blocked in the associated angular position.

When the securing hook 15 is rotated downwards, the engaging attachment 24 will hit against the lower stop 27 of the securing bolt 23, subsequently displacing the securing bolt 23 downwards, the bolt entering with its lower end into a recess in the upper support leg section 19. In this position, the support leg is secured in the vertical position, and the seat boom 4 is released for rotation (FIG. 4).

Figure 5:
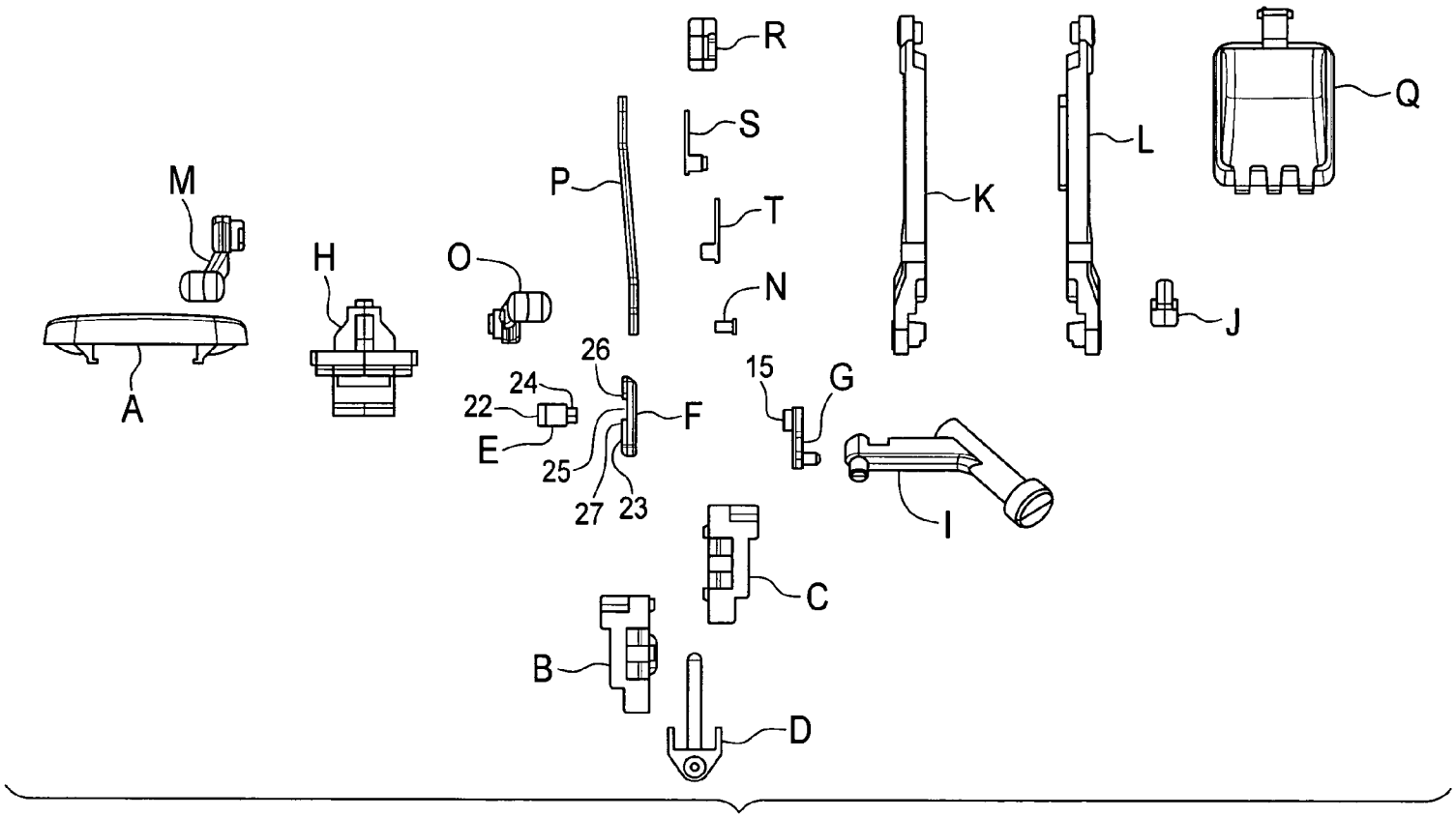
FIG. 5 is an illustration showing the individual parts of the rear excavator.

In reference to FIG. 5 the following table comprises an associated parts list of the rear excavator.

PARTS LIST

| No. | Quantity | Designation |
|---|---|---|
| A | 1 | 261_000_007-SEAT SHELL01 |
| B | 1 | D01-RECEIVING BLOCK RIGHT |
| C | 1 | D01-RECEIVING BLOCK LEFT |
| D | 1 | D01-COUPLING BOLT |
| E | 1 | D01-ENGAGING MEANS |
| F | 1 | D01-SECURING BOLT |
| G | 1 | D01-SECURING HOOK |
| H | 1 | D01-SEAT-BOOM |
| I | 1 | D01-SUPPORT LEG |
| J | 1 | D02-BOOM-HOOK |
| K | 1 | D02-BOOM-LEFT |
| L | 1 | D02-BOOM-RIGHT |
| M | 1 | D02-LEVER-LEFT |
| N | 1 | D02-LEVER-RIGHT-SLEEVE |
| O | 1 | D02-LEVER-RIGHT |
| P | 1 | D02-PARALLEL LINKAGE |
| Q | 1 | D02-SHOVEL |
| R | 1 | D02-SHOVEL ARM |
| S | 1 | D02-SHEAR LINKAGE-LEFT |
| T | 1 | D02-SHEAR LINKAGE-RIGHT |

The invention claim is:

1. A toy vehicle, especially a pedal vehicle for children, comprising a rear excavator fastened to the toy vehicle, a seat boom rotatably arranged on a receiving block which is fastened to the toy vehicle, a support leg mounted on the receiving block and pivotable between a lifted position and a lowered position in which the support leg rests on the ground, and the receiving block has mounted thereon a securing hook means which in a first position locks the support leg in the raised position and, at the same time, locks the seat boom in a predetermined angular position and which in a second position secures the support leg in the lowered position and, moreover, releases the seat boom for rotation.

2. The toy vehicle according to claim 1, wherein the securing hook means comprises a securing hook which is rotatable about an axis, an engaging means-which is non-rotatably connected to the securing hook, and a securing bolt which is displaceably arranged in the receiving block.

3. The toy vehicle according to claim 2, wherein the securing bolt is displaceable between an upper position in which it engages into a recess of the seat boom, and a lower position in which it engages into a recess of the lowered support leg.

4. The toy vehicle according to claim 1 wherein the support leg contains two support leg sections extending at an angle relative to one another, and is pivotable with its end facing away from a support foot about an axis inclined relative to the vertical.

5. The toy vehicle according to claim 2, wherein the securing hook can grip behind the support leg with a hook-like projection when the support leg is in the lifted position.

6. The toy vehicle according to claim 1 wherein the seat boom contains a seat shell fixedly mounted on a boom.

7. The toy vehicle according to claim 1 wherein a linkage contains an excavator arm which is hinged with an end to the seat boom, and hingedly supports, with the other end, a shovel arm having a hinged shovel, and that the excavator arm is detachably fixable in a raised end position.

8. The toy vehicle according to claim 7, wherein the excavator arm has pivotably mounted thereon a second securing hook which due to gravity in the raised end position of the excavator arm can grip behind a stop provided on the seat boom.

* * * * *

UNITED STATES PATENT AND TRADEMARK OFFICE

CERTIFICATE OF CORRECTION

PATENT NO. : 7,347,763 B2
APPLICATION NO. : 10/990781
DATED : March 25, 2008
INVENTOR(S) : Ulrich Ewrigmann It is certified that error appears in the above-identified patent and that said Letters Patent is hereby corrected as shown below:

On the title page of U.S. Patent No. 7,347,763, line 30 Foreign Application Priority Data should read:

delete "Sep. 3, 2004 (DE) ..... 10 2004 042 646" and insert
--Sep. 3, 2004 (DE) .....10 2004 042 646.5--

Signed and Sealed this

Twenty-ninth Day of July, 2008

JON W. DUDAS
*Director of the United States Patent and Trademark Office*